US005289887A

United States Patent [19]

Püttmann

[11] Patent Number: 5,289,887

[45] Date of Patent: Mar. 1, 1994

[54] METHOD OF OPERATING AN EARTH BORING MACHINE

[75] Inventor: Franz-Josef Püttmann, Lennestadt-Saalhausen, Fed. Rep. of Germany

[73] Assignee: Tracto-Technik Paul Schmidt Spezialmaschinen KG, Lennestadt, Fed. Rep. of Germany

[21] Appl. No.: 866,767

[22] Filed: Apr. 3, 1992

[51] Int. Cl.[5] ..... E21B 6/00

[52] U.S. Cl. ..... 175/61; 173/105; 173/203; 175/62; 175/73; 175/122; 175/135; 175/162

[58] Field of Search ..... 175/113, 135, 162, 122, 175/202, 203, 189, 220, 57, 61, 62, 73; 173/105, 203, 53

[56] References Cited

U.S. PATENT DOCUMENTS

| | | | |
|---|---|---|---|
| 1,518,549 | 12/1924 | Prescott | 173/203 |
| 1,699,936 | 10/1927 | Watchozn . | |
| 1,916,466 | 8/1932 | Eckles . | |
| 2,094,353 | 9/1937 | Gartin | 175/122 X |
| 2,317,158 | 4/1943 | Westover | 173/203 X |
| 3,071,199 | 1/1963 | Richmond | 175/122 |
| 3,231,032 | 1/1966 | Genberg et al. | 173/105 X |
| 3,525,405 | 8/1970 | Coyne et al. | 175/19 |
| 3,599,731 | 8/1971 | Lawlis | 173/88 |
| 3,656,563 | 4/1972 | Blinne | 175/22 |
| 3,786,874 | 1/1974 | Joder et al. | 173/105 X |
| 4,161,990 | 7/1979 | Fornberg et al. | 173/105 |
| 4,341,271 | 7/1982 | Anttila | 173/105 X |
| 4,854,394 | 8/1989 | Heinonen | 173/105 |
| 5,010,965 | 4/1991 | Schmelzer | 175/62 X |

FOREIGN PATENT DOCUMENTS

| | | |
|---|---|---|
| 0247767 | 12/1987 | European Pat. Off. . |
| 7108077 | 3/1971 | Fed. Rep. of Germany . |
| 2824722 | 12/1979 | Fed. Rep. of Germany . |
| 8337248 | 4/1984 | Fed. Rep. of Germany . |
| 3741373 | 4/1989 | Fed. Rep. of Germany . |

*Primary Examiner*—Hoang C. Dang

*Attorney, Agent, or Firm*—Anderson Kill Olick & Oshinsky

[57] ABSTRACT

In a method of operating a ram boring machine having a rotatory-thrust drill rod an impact force is applied to the rear end of the drill rod. The boring machine includes a thrust unit and a striking tool that are combined to form a thrust/percussion aggregate.

20 Claims, 2 Drawing Sheets

METHOD OF OPERATING AN EARTH BORING MACHINE

TECHNICAL FIELD OF THE INVENTION

The invention relates to a method of operating an earth boring machine having a rotatory/percussion drill rod, that is to say, a drill rod that can both be rotated and subjected to thrust forces, and to an earth boring machine for carrying out the method.

BACKGROUND OF THE INVENTION AND PRIOR ART

Disclosed in European Offenlegungsschrift 0 247 767 is a controllable boring machine for drilling holes in the ground, in particular for laying supply lines such as water pipes or cables beneath streets or embankments or other building structures and obstacles without digging trenches, that consists essentially of a pneumatic or hydraulic drive unit arranged on a mounting which statically pushes a drill rod further and further into the ground and sets it in rotation. At the tip of the drill rod there is a ram boring machine having a percussion piston which can reciprocate in a tubular housing of the machine. The ram boring machine has a head with an oblique face by which the ram boring machine and the drill rod that is pulled along and/or pushed in behind it is steered along a certain radius from the depth of the earth bore made in the ground up to the surface. However, because the ram boring machine and striking tool are arranged ahead of the drill rod it is not possible to prevent the machine, particularly in the case of soft soils, from deviating downwards from the running direction due to its weight, so that frequent correction of the direction is required.

The majority of compressed-air-driven ram boring machines connected at the rear end via supply hoses to a compressed-air source arranged outside of the earth bore are turned on and off by normal shut-off valves, e.g. ball valves. As the length of the hose between the shut-off valve at the compressed-air source and the ram boring machine may be some 20 to 100 m, the pressure in the hose and in the ram boring machine builds up relatively slowly after the shut-off valve is opened. As this occurs the percussion piston can be displaced unfavourably in the ram boring machine so that the front and rear faces of the percussion piston are acted on by the same pressure, so that a dead center position results from which the percussion piston can only be started up by a pulse of compressed air. Furthermore the length of the air column can lead to uncontrollable compression effects, and possibly to self-oscillations of the air column, which make starting up the machine difficult. Moreover the ram boring machine often becomes iced up due to the expansion of the compressed air, which is extremely disadvantageous. Finally, if the ram boring machine at the tip of the drill rod gets stuck in the earth bore due to malfunctioning, there is no other alternative but to dig the ground right up.

OBJECT OF THE INVENTION

It is an object of the invention to provide a method and an earth boring machine by which, with structurally simple means, said disadvantages of known earth boring machines can be obviated.

SUMMARY OF THE INVENTION

The method by which this end is achieved, according to the invention, is to apply an impact force to the rear end of the drill rod. By this means all the above-mentioned problems, which occur with the known earth boring machines because the striking tool is arranged at the front on the drill rod, are solved in a surprisingly simple manner. This is because, according to the invention, both the striking tool and the thrust unit are located outside of the earth bore, thus leaving all the mechanical parts freely accessible all the time, and furthermore no long supply hoses for the pressure medium are needed that have to be pulled along in the earth bore.

In a boring machine that acts on the drill rod from the rear a thrust unit and a striking tool are preferably combined to form a thrust/percussion aggregate. A two-stroke process can then be employed when moving the drill rod into the ground: as soon as resistance is met which cannot be overcome by a thrust force alone, the thrust force of the thrust/percussion aggregate, which is advantageously arranged to transmit force to the drill rod but is not positively connected thereto, is supplemented or assisted by the striking force. The functions of the boring machine can be controlled, for example, by an operator using handy remote control means. Whilst the size, and thus the striking force, of striking tools arranged at the front of the drill rod always depends on the diameter of the earth bore, the striking power that can be used when striking the rear end of the drill rod is completely independent of the diameter of the earth bore. In addition earth bores of different diameters can be made using the same thrust/percussion aggregate merely by suitably adapting the diameter of the drill rod or the boring head.

It is advantageous to connect together the thrust/percussion aggregate and a rotary drive accommodating the drill rod. In this way, although the systems are separate, their functions can be combined, preferably by mounting the thrust/percussion aggregate and the rotary drive each on its own respective carriage guided on a mounting. The auxiliary striking force that is applied when necessary is transmitted directly and fully via the carriage of the thrust/percussion aggregate—hereinafter called the thrust/percussion carriage—on to the drill rod.

It is advantageous if the thrust/percussion carriage is driven and is joined to the rotary drive carriage by a tension connection. The advantageous separation of the systems can be realised with just one drive, which can advantageously be a rack-and-pinion drive which—in contrast, for example, to the use of a hydraulic or pneumatic cylinder to apply the thrust—does not need to be so long in order to achieve the forward thrust. When moving backwards to enable a new rod to be added on the thrust/percussion carriage takes the rotary drive carriage with it, via the tension connection, e.g. a chain or a rope. Apart from those mentioned any drive producing a linear movement, such as a cable or chain drive with suitable reversing means, is suitable for the thrust/percussion carriage.

If the drill rod is connected non-rotatably to a ram mounted to move longitudinally in the rotary drive damage to the rotary drive, which is preferably a chain drive that drives the drill rod via at least one chain, can be avoided if the ram is mounted in a bearing in a toothed wheel that transmits the torque. There is thus a movable member between the striking tool and the drill rod, and the striking tool acts directly on the rear end of the drill rod. The thrust/percussion aggregate and the drive for rotating the drill rod can be operated independently of one another.

If, as is advantageous, the drill rod is provided with a head having an oblique face, which may be formed as a steering head with an electronic unit exactly following and controlling the progress of the bore, a positive change in course, e.g. to avoid obstacles or to move on a radius, can be achieved by interrupting the rotation during translatory advance, depending on the position of the oblique steering head, which is indicated on a dial on a measuring device outside the earth bore.

A self-propelled ram boring machine that can be connected to the drill rod either non-positively or positively through a coupling is suitable as a striking tool. If, as is advantageous, the striking tool comprises a prestressed percussion piston arranged in a housing, an extremely compact structure results. A compression spring may be associated with the percussion piston to serve as a driving spring that produces striking impulses in quick succession to accelerate the percussion piston forwards. Other means of storing up pressure that can provide a suitable impulse, e.g. nitrogen accumulators, can be used instead of a compression spring.

It is advantageous if an extension of the percussion piston projects from one end of the housing and a piston rod from the other end. The piston extension bears against the ram to transmit the thrust and/or striking force to the drill rod. A driven cam wheel which engages in a groove in the piston rod can advantageously be provided to pretension the compression spring. The cam wheel, which advantageously has three cams and moves counter to the direction of advance, thus pulls the piston back against the force of the compression spring, which is thereby pretensioned. As only one cam of the cam wheel at a time engages with a curved end into the groove arranged outside the housing favourable frictional behaviour similar to rolling friction results.

If the cam wheel driving motor is mounted vertically no additional space is required, and the space in the upper part of the trench that is already free can be used to fit the motor.

Only one driving medium is required for all the drives, which are preferably hydraulic or pneumatic; the drives can be connected in a simple manner to hydraulic or pneumatic machines (excavators or compressors) that are usually to be found on the building site.

If the head of the rod is interchangeable, heads with suitably slanting oblique faces can be used to obtain different turning radii.

When the head of the rod is provided with a drill flute the drill rod is pulled into the ground because the groove acts as a screw thread. The thrust force to be produced by the thrust/percussion aggregate may then be smaller and the support of the mounting considerably less expensive. Furthermore the drill flute makes it possible to remove the drillings rearwards.

If the head of the rod is provided with a centering tip this helps to ensure straight forward movement of the drill rod, since—in particular when operating in solid ground—the centering tip draws itself ahead into the ground as the drill rod is fully rotated.

When using hollow drill rods the longitudinal bore of the rod can furthermore be used to supply fluid to lubricate the rod or to cool the boring head via a turning knuckle that is arranged centrally between the rotary drive and the rearmost rod. Furthermore the fluid helps to a sensor located in the steering head from becoming too hot due to the continuous rotation and the friction with the ground resulting therefrom.

BRIEF DESCRIPTION OF THE DRAWINGS

The invention will now be described in more detail with reference to an exemplary embodiment shown in the drawing in which.

DETAILED DESCRIPTION OF A PREFERRED EMBODIMENT OF THE INVENTION

Figure 2:
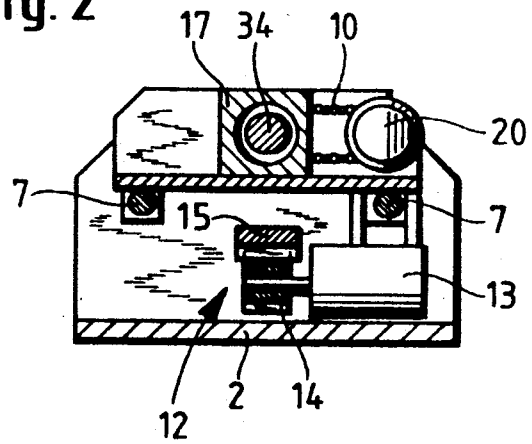
FIG. 2 shows the boring machine shown in FIG. 1 sectioned along the line II—II.

An earth boring machine 1 comprises a mounting 2, a thrust/percussion aggregate 3 arranged thereon and a rotary drive 4. The thrust/percussion aggregate 3 and the rotary drive 4 are arranged on carriages 5, 6 that slide on guide rails 7. The carriages 5, 6 are separated from one another and joined together only in tension by a chain 8. To move a drill rod 9, which can be extended as desired by attaching new sections, in the forward direction 11 the thrust/percussion aggregate 3 is moved forward by a gear drive 12 that comprises a motor 13 with a pinion 14 that meshes with a toothed rack 15 extending along the entire length of the mounting 2 (cf. FIG. 2).

Figure 1:
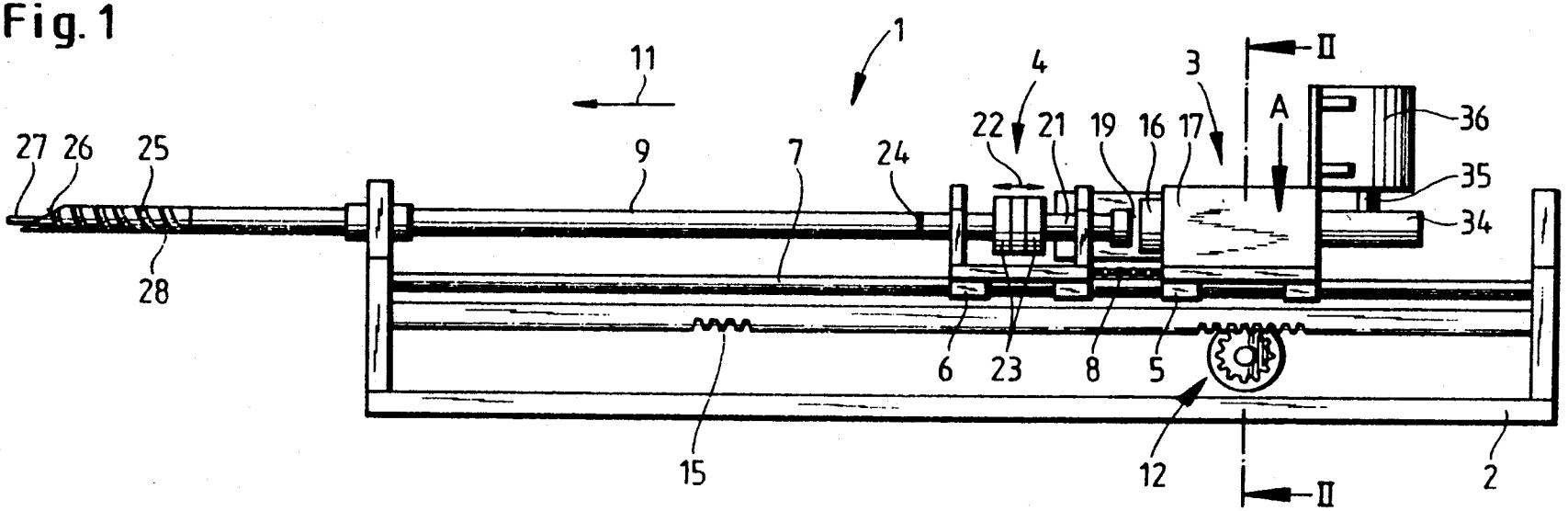
FIG. 1 shows, in longitudinal section, an earth boring machine according to the invention with a thrust/percussion aggregate arranged at the rear end of the drill rod.

To transmit the thrust force a piston extension 16 of a percussion piston 18 arranged in a housing 17 of the carriage 5 of the thrust/percussion aggregate 3 (cf. FIG. 3) bears non-positively against a ram surface 19 (cf. FIG. 1) of a ram 21 arranged between the drill rod 9 and the piston extension 16. The ram 21 is mounted in a bearing in sprockets 23 of the rotary chain drive 4 (a chain 10 and a hydraulic motor 20 driving it are shown schematically in FIG. 2) so as to be longitudinally displaceable in the direction of the double arrow 22. To rotate the drill rod 9, said rod is connected non-rotatably to the ram 21 at the connection point indicated in FIG. 1 by 24. The drill rod 9 is provided with an exchangeable head 28 having a screw-thread-like drill flute 25, an oblique face 26 and a centering tip 27.

Figure 3:
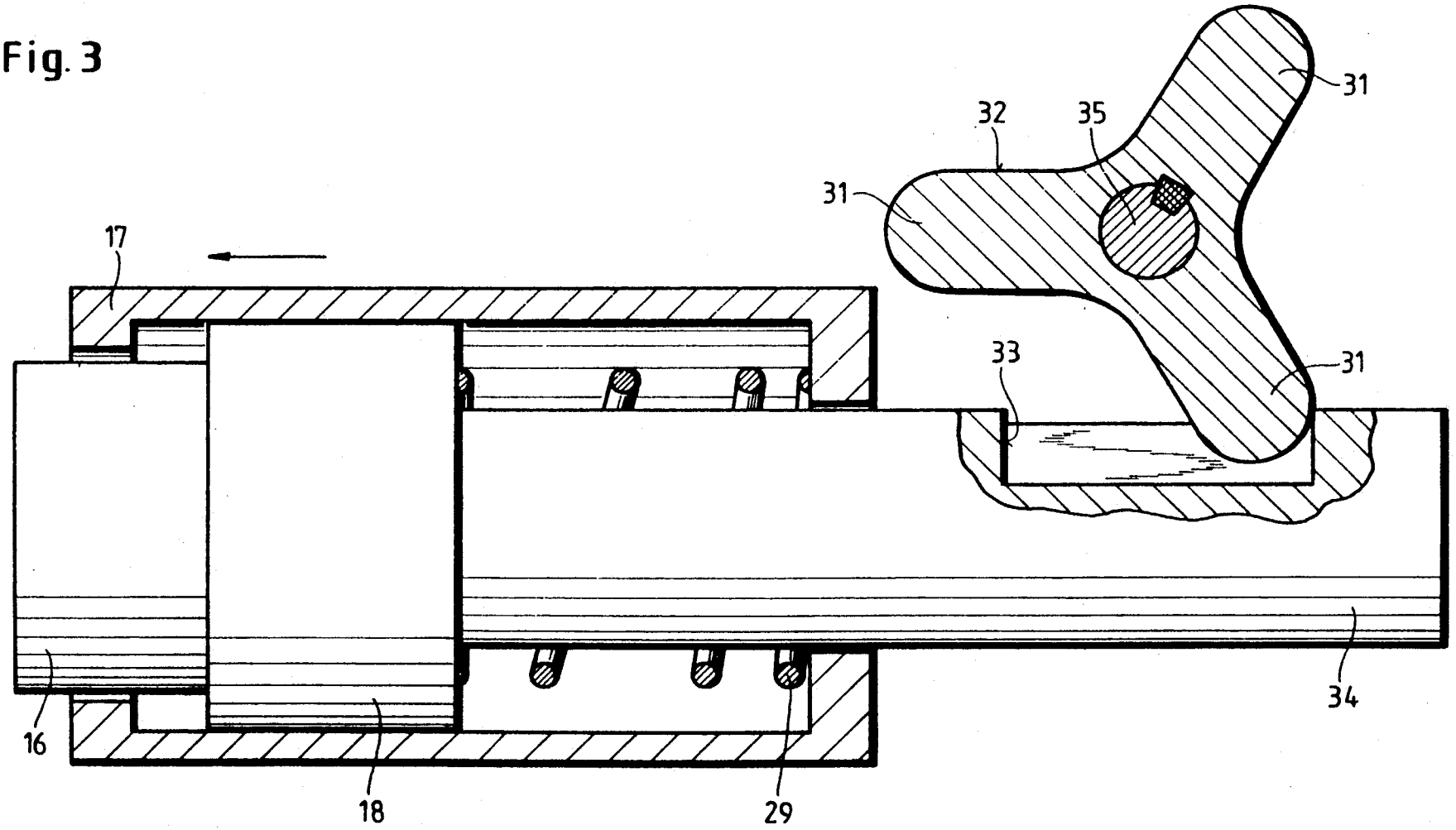
FIG. 3 shows, in cross-section, as a detail a percussion piston pre-tensioned by a cam wheel arranged in a housing of the thrust/percussion aggregate shown in FIG. 1, viewed in the direction of the arrow A in FIG. 1.

If the drill rod 9 strikes an obstacle when moving forwards that cannot be overcome by the thrust force alone the drill rod 9 is acted on via the intermediate ram 21 by means of the piston 18 (cf. FIG. 3), i.e. from the rear end, by impacts at a high impulse rate. For this purpose the percussion piston 18 is accelerated by a pre-tensioned compression spring 29 arranged in the housing 17 of the thrust/percussion aggregate 3, as shown in FIG. 3. To pre-tension the compression spring 29 a cam wheel 32 with three cams 31 engages in a groove 33 in a piston rod 34 extending outwards through the housing 17. The cam wheel 32 is connected via a drive shaft 35 to a hydraulic motor 36 which, when in operation, causes the cams 31 to engage in quick succession with the groove 33 and correspondingly tension the compression spring 29, so that the compression spring is tensioned and relaxed in quick succession thus resulting in a correspondingly quick succession of strokes of the percussion piston 18. As soon as the obstacle is overcome the motor 36 is turned off and the drill rod 9 is again moved forward into the ground in the advancing direction 11 by the thrust force alone.

What is claimed is:

1. An earth boring machine, comprising:

a rotary-thrust rod and having a front end located in a drilled bore and a rear end outside of the drilled bore;

a rotary-thrust unit for imparting a rotary-thrust movement to said drill rod;

a striking tool for applying an impact force to the rear end of said drill rod, said striking tool and said rotary-thrust forming together a thrust percussion aggregate; and a head with an oblique face provided at the front end of said drill rod for controlling the progress of the drilled bore.

2. A boring machine according to claim 1, wherein said thrust/percussion aggregate can be connected to a rotary drive accommodating said drill rod.

3. A boring machine according to claim 2, wherein said thrust/percussion aggregate and said rotary drive are arranged in carriages guided on a mounting.

4. A boring machine according to claim 3, wherein said thrust/percussion aggregate is driven and has a tension-resistant connection to a rotary drive carriage.

5. A boring machine according to claim 1, wherein said thrust/percussion aggregate has a rack-and-pinion drive.

6. A boring machine according to claim 2, wherein said drill rod is connected non-rotatably to a ram that can be moved longitudinally in said rotary drive.

7. A boring machine according to claim 6, wherein said drill rod is driven via at least one chain and said ram is mounted in a bearing in a gear wheel transmitting the torque.

8. A boring machine according to claim 2, wherein said thrust/percussion aggregate and said drill rod are joined together with a non-positive connection.

9. A boring machine according to claim 2, wherein said striking tool of said thrust/percussion aggregate is a self-propelled ram boring machine.

10. A boring machine according to claim 2, wherein said striking tool comprises a pre-tensioned percussion piston arranged in a housing.

11. A boring machine according to claim 10, wherein a compression spring is associated with said percussion piston.

12. A boring machine according to claim 10, wherein said percussion piston comprises an extension that projects from said housing at one end and a piston rod that projects from said housing at the other end.

13. A boring machine according to claim 12, which includes a driven cam wheel engaging in a groove in the piston rod and serving to pre-tension said compression spring.

14. A boring machine according to claim 13, wherein said cam wheel has three cams.

15. A boring machine according to claim 13, wherein the drive of said cam wheel is vertically-mounted.

16. A boring machine according to claim 1, which includes an hydraulic or pneumatic drive.

17. A boring machine according to claim 1, wherein said head is exchangeable.

18. A boring machine according to claim 1, wherein said head is provided with a drill flute.

19. A boring machine according to claim 1, wherein said head has a centering tip.

20. A method of operating an earth boring machine including a rotary-thrust drill rod having a front end located in a drilled bore and a rear end outside of the drilled bore, said method comprising the steps of:

providing, at the front end of the drill rod, a head having an oblique face for controlling progress of a drilled bore;

imparting a rotary-thrust movement to the drill rod;

applying an impact force to the rear end of the drill rod upon registration of an obstacle to advancement of the drill rod;

temporary interrupting rotation of the drill rod for changing an advancing direction of the drill rod.

* * * * *